US008640509B2

(12) United States Patent
Will

(10) Patent No.: US 8,640,509 B2
(45) Date of Patent: Feb. 4, 2014

(54) SECURITY ASSEMBLY FOR ATTACHMENT TO AN OBJECT

(75) Inventor: Adam Mark Will, Fort Mill, SC (US)

(73) Assignee: Checkpoint Systems, Inc.

( * ) Notice: Subject to any disclaimer, the term of this patent is extended or adjusted under 35 U.S.C. 154(b) by 182 days.

(21) Appl. No.: 13/097,794

(22) Filed: Apr. 29, 2011

(65) Prior Publication Data

US 2011/0283750 A1 Nov. 24, 2011

Related U.S. Application Data

(60) Provisional application No. 61/330,240, filed on Apr. 30, 2010.

(51) Int. Cl.
*E05B 65/00* (2006.01)

(52) U.S. Cl.
USPC ..... 70/57.1; 70/14; 70/57; 70/58; 70/18

(58) Field of Classification Search
USPC ..... 70/14, 18, 19, 30, 49, 57.1, 57, 58, 416
See application file for complete search history.

(56) References Cited

U.S. PATENT DOCUMENTS

| | | | |
|---|---|---|---|
| 1,964,058 | A | 6/1934 | Holtzman |
| 2,870,239 | A | 1/1959 | Ustin |
| 2,880,489 | A | 4/1959 | Burbank |
| 3,116,945 | A | 1/1964 | Blomquist et al. |
| 3,636,547 | A | 1/1972 | Brace et al. |
| 3,929,031 | A | 12/1975 | Webb |
| 4,061,893 | A | 12/1977 | Sanner |
| 4,102,022 | A | 7/1978 | Aoki |
| 4,400,967 | A | 8/1983 | Owens |
| 4,515,991 | A | 5/1985 | Hutchison |
| 4,733,453 | A | 3/1988 | Jacoby |
| 4,751,017 | A | 6/1988 | Wachtler et al. |
| 4,751,350 | A | 6/1988 | Eaton |
| 4,786,900 | A | 11/1988 | Karasawa et al. |
| 4,957,017 | A | 9/1990 | Corbett |

(Continued)

FOREIGN PATENT DOCUMENTS

| | | | |
|---|---|---|---|
| WO | WO 98/40591 | A1 | 9/1998 |
| WO | WO 2006/123152 | A1 | 11/2006 |
| WO | WO 2008/057740 | A2 | 5/2008 |

OTHER PUBLICATIONS

International Search Report and Written Opinion for corresponding International Application No. PCT/US2010/027018 mailed Jul. 6, 2010.

(Continued)

*Primary Examiner* — Suzanne Barrett

(57) ABSTRACT

Embodiments of the present invention provide a security assembly configured to properly secure articles in a retail environment. In some embodiments, the security assembly is configured to secure cylindrical objects, such as baby formula or coffee cans. Additionally, in some embodiments, the security assembly may be adjustable such that differently sized objects may be secured. In an example embodiment, a security device for securing an object with an object perimeter edge is provided. The security device comprises a housing defining an edge lock configured for positioning proximate the object perimeter edge and a locating gap. The security device also comprises at least one cable extending from the security device through the locating gap. The locating gap is configured to secure the at least one cable from substantial lateral movement in at least one direction.

18 Claims, 7 Drawing Sheets

(56) References Cited

U.S. PATENT DOCUMENTS

| | | | | |
|---|---|---|---|---|
| 4,979,382 | A * | 12/1990 | Perry | 70/58 |
| 5,195,860 | A | 3/1993 | Steyn | |
| 5,369,970 | A * | 12/1994 | Voiculescu et al. | 70/240 |
| 5,434,552 | A | 7/1995 | Ems | |
| 5,520,031 | A * | 5/1996 | Davidge | 70/18 |
| 5,541,377 | A | 7/1996 | Stuhlmacher | |
| 5,647,620 | A | 7/1997 | Kuenzel | |
| 5,664,449 | A | 9/1997 | Sedley | |
| 5,667,092 | A | 9/1997 | Julius et al. | |
| 5,689,240 | A | 11/1997 | Traxler | |
| 5,711,558 | A | 1/1998 | Woody | |
| 5,722,266 | A * | 3/1998 | Yeager et al. | 70/57 |
| 5,794,464 | A * | 8/1998 | Yeager et al. | 70/57 |
| 5,803,692 | A | 9/1998 | Postadan | |
| 5,842,359 | A * | 12/1998 | Longueira | 70/14 |
| 5,936,530 | A | 8/1999 | Meinhold | |
| 5,969,613 | A | 10/1999 | Yeager et al. | |
| 6,092,401 | A | 7/2000 | Sankey et al. | |
| 6,125,669 | A * | 10/2000 | McDaid et al. | 70/58 |
| 6,149,455 | A | 11/2000 | Levi | |
| 6,179,646 | B1 | 1/2001 | Horchler | |
| 6,189,407 | B1 | 2/2001 | Champ et al. | |
| 6,230,526 | B1 * | 5/2001 | Fontes et al. | 70/18 |
| 6,237,375 | B1 * | 5/2001 | Wymer | 70/14 |
| 6,298,695 | B1 * | 10/2001 | Vezina et al. | 70/58 |
| 6,308,928 | B1 * | 10/2001 | Galant | 248/553 |
| 6,388,558 | B1 | 5/2002 | Emmei | |
| 6,438,802 | B1 | 8/2002 | Beeman et al. | |
| 6,453,795 | B1 | 9/2002 | Eicher et al. | |
| 6,672,269 | B1 | 1/2004 | Bonde et al. | |
| 6,931,265 | B2 | 8/2005 | Reyes et al. | |
| 6,994,370 | B2 | 2/2006 | Sabol | |
| 7,053,774 | B2 | 5/2006 | Sedon et al. | |
| 7,098,792 | B1 | 8/2006 | Ahlf et al. | |
| 7,129,841 | B2 | 10/2006 | Feibelman | |
| 7,162,899 | B2 | 1/2007 | Fawcett et al. | |
| 7,168,275 | B2 | 1/2007 | Fawcett et al. | |
| 7,174,752 | B2 * | 2/2007 | Galant | 70/58 |
| 7,227,467 | B2 | 6/2007 | Feibelman | |
| 7,251,966 | B2 | 8/2007 | Fawcett et al. | |
| 7,272,962 | B2 * | 9/2007 | Benda et al. | 70/18 |
| 7,350,381 | B2 | 4/2008 | Fawcett et al. | |
| 7,385,522 | B2 | 6/2008 | Belden, Jr. et al. | |
| 7,403,118 | B2 | 7/2008 | Belden, Jr. | |
| 7,446,664 | B2 | 11/2008 | White | |
| 7,479,879 | B2 | 1/2009 | Merrem et al. | |
| 7,481,086 | B2 | 1/2009 | Fawcett et al. | |
| 7,497,100 | B2 | 3/2009 | Fawcett et al. | |
| 7,497,101 | B2 | 3/2009 | Fawcett et al. | |
| 7,522,048 | B2 | 4/2009 | Belden, Jr. | |
| 7,543,466 | B2 * | 6/2009 | Loughlin et al. | 70/8 |
| 7,562,422 | B2 | 7/2009 | D'Addario et al. | |
| 7,659,817 | B2 | 2/2010 | Conti et al. | |
| 7,682,100 | B2 | 3/2010 | Duval | |
| 7,685,850 | B2 * | 3/2010 | Nilsson | 70/18 |
| 7,737,846 | B2 | 6/2010 | Belden, Jr. et al. | |
| 7,808,382 | B2 * | 10/2010 | Bonato | 340/568.2 |
| 7,836,734 | B2 * | 11/2010 | Lynch | 70/58 |
| 7,918,112 | B2 | 4/2011 | Fawcett et al. | |
| 7,936,267 | B2 | 5/2011 | Pasma | |
| 7,969,305 | B2 | 6/2011 | Belden, Jr. et al. | |
| 7,984,629 | B2 * | 7/2011 | Xiaobin | 70/57 |
| 8,002,232 | B2 * | 8/2011 | Meislahn | 248/551 |
| 8,087,269 | B2 | 1/2012 | Conti et al. | |
| 8,122,744 | B2 * | 2/2012 | Conti et al. | 70/57.1 |
| 8,281,626 | B2 * | 10/2012 | Conti et al. | 70/57.1 |
| 2002/0089434 | A1 | 7/2002 | Ghazarian | |
| 2002/0134119 | A1 * | 9/2002 | Derman | 70/58 |
| 2003/0230870 | A1 | 12/2003 | Sabol | |
| 2004/0032333 | A1 | 2/2004 | Hatt | |
| 2005/0051978 | A1 | 3/2005 | Sabol | |
| 2005/0242959 | A1 | 11/2005 | Watanabe | |
| 2005/0264383 | A1 | 12/2005 | Zhang | |
| 2006/0123856 | A1 * | 6/2006 | Loughlin et al. | 70/18 |
| 2006/0137409 | A1 | 6/2006 | Fawcett et al. | |
| 2006/0137411 | A1 | 6/2006 | Fawcett et al. | |
| 2006/0145848 | A1 | 7/2006 | Marsilio et al. | |
| 2006/0169008 | A1 | 8/2006 | Fawcett et al. | |
| 2006/0170550 | A1 | 8/2006 | Marsilio et al. | |
| 2007/0039360 | A1 | 2/2007 | Fawcett et al. | |
| 2007/0080806 | A1 | 4/2007 | Lax et al. | |
| 2007/0101775 | A1 | 5/2007 | Fawcett et al. | |
| 2007/0107477 | A1 | 5/2007 | Fawcett et al. | |
| 2007/0120669 | A1 | 5/2007 | Belden, Jr. | |
| 2007/0146134 | A1 | 6/2007 | Belden et al. | |
| 2007/0152836 | A1 | 7/2007 | Nagelski et al. | |
| 2007/0159328 | A1 | 7/2007 | Belden et al. | |
| 2008/0034815 | A1 | 2/2008 | Fawcett et al. | |
| 2008/0061975 | A1 | 3/2008 | Belden, Jr. et al. | |
| 2008/0076479 | A1 | 3/2008 | Nagamine et al. | |
| 2008/0169924 | A1 | 7/2008 | Belden | |
| 2008/0186550 | A1 | 8/2008 | Meuwese et al. | |
| 2008/0236209 | A1 | 10/2008 | Conti et al. | |
| 2008/0251623 | A1 | 10/2008 | Goldstein et al. | |
| 2008/0303670 | A1 | 12/2008 | Seidel | |
| 2008/0316028 | A1 | 12/2008 | Conti et al. | |
| 2009/0158786 | A1 | 6/2009 | Fawcett et al. | |
| 2009/0223260 | A1 | 9/2009 | Conti et al. | |
| 2009/0267766 | A1 | 10/2009 | Pasma | |
| 2009/0288460 | A1 | 11/2009 | Zhang et al. | |
| 2009/0289798 | A1 | 11/2009 | Yang | |
| 2009/0323287 | A1 | 12/2009 | Patterson | |
| 2010/0090830 | A1 | 4/2010 | Conti et al. | |
| 2010/0139336 | A1 | 6/2010 | Necchi | |
| 2010/0171621 | A1 | 7/2010 | Yang | |
| 2010/0231388 | A1 | 9/2010 | Shute et al. | |
| 2011/0068906 | A1 | 3/2011 | Shafer | |
| 2011/0068921 | A1 | 3/2011 | Shafer | |
| 2011/0094274 | A1 | 4/2011 | Conti et al. | |
| 2011/0115632 | A1 | 5/2011 | Yang | |
| 2011/0154867 | A1 | 6/2011 | Fawcett et al. | |
| 2011/0199210 | A1 | 8/2011 | McLean | |
| 2011/0203327 | A1 * | 8/2011 | Fong | 70/14 |
| 2011/0227706 | A1 | 9/2011 | Yang | |
| 2011/0241879 | A1 | 10/2011 | Fawcett et al. | |
| 2011/0254661 | A1 | 10/2011 | Fawcett et al. | |
| 2011/0260594 | A1 | 10/2011 | Yang | |
| 2011/0283750 | A1 | 11/2011 | Will | |
| 2011/0283751 | A1 * | 11/2011 | Avganim | 70/18 |
| 2011/0283754 | A1 * | 11/2011 | Ezzo et al. | 70/57.1 |
| 2011/0308283 | A1 * | 12/2011 | Nilsson | 70/57.1 |
| 2012/0223838 | A1 * | 9/2012 | Conti et al. | 340/572.1 |
| 2012/0234055 | A1 * | 9/2012 | Bland et al. | 70/15 |

OTHER PUBLICATIONS

International Search Report and Written Opinion for International Application No. PCT/US2011/034532, mailed Sep. 29, 2011.

* cited by examiner

SECURITY ASSEMBLY FOR ATTACHMENT TO AN OBJECT

CROSS REFERENCE TO RELATED APPLICATIONS

This patent application claims priority from U.S. Provisional Patent Application No. 61/330,240, filed Apr. 30, 2010, entitled "Security Assembly for Attachment to an Object," which is hereby incorporated herein by reference in its entirety.

FIELD

Embodiments discussed herein are related to security assemblies structured for attachment to an object and, more particularly, security assemblies structured for attachment to retail products.

BACKGROUND

Deterring and preventing product theft is important in all retail environments. Balancing a desire for robust presentation and accessibility of retail products with proper security can be difficult. The development of electronic article surveillance ("EAS") has helped deter retail theft while maintaining display options for retail products. In particular, tags or other security assemblies can be placed on products, and these tags may contain EAS, radio frequency identification ("RFID"), or other technologies that can track the product and alarm if the article is being tampered with or stolen to deter retail theft.

Cable wrap security devices, such as those described in U.S. Pat. No. 7,497,101 and U.S. Patent Pub. No. 2009-0223260-A1, which are each hereby incorporated by reference in their entirety, embody one common form factor for the above described tags. Applicant has identified a number of deficiencies and problems associated with the manufacture, use, design, and operation of conventional cable wrap security devices. Through applied effort, ingenuity, and innovation, Applicant has solved many of these identified problems by developing a solution that is embodied by the present invention, which is described in detail below.

BRIEF SUMMARY OF THE INVENTION

It is desirable to protect retail products or articles from theft or unauthorized access. Cable wrap security devices have been used with great success to secure retail products; however, when placed on cylindrical products (e.g., baby formula containers, etc.), such cable wrap security devices may prove difficult to use or ineffective. For example, a would-be thief may, in some cases, manipulate the cable(s) of a locked cable wrap security device around the round sides of the cylindrical product in order to free the product and thereby defeat the cable wrap security device without an authorized unlocking step. In hopes of reducing this concern, a retailer may train its personal to secure the cable(s) of the cable wrap security device more tightly; however, such tightening may not solve the problem (i.e., the cable(s) may still be pulled over rounded sides) and over tightening of the cable wrap security device may damage the retail product.

Various embodiments of the present invention are directed to a security assembly configured to reliably secure cylindrical objects (e.g., baby formula containers, etc.) or other objects that define rounded corners or sides. In some embodiments, the security assembly may be adjustable such that differently sized objects may be secured.

In an example embodiment, a security device for securing an object with an object perimeter edge is provided. The security device comprises a housing defining an edge lock configured for positioning proximate the object perimeter edge and a locating gap. The security device also comprises at least one cable extending from the security device through the locating gap. The locating gap is configured to secure the at least one cable from substantial lateral movement in at least one direction.

In another embodiment, an assembly for securing an object defining an object perimeter edge is provided. The assembly comprises a security device and an adapter. The security device comprises at least one cable extending from the security device. The adapter defines a pocket for receiving the security device and an edge lock configured for positioning proximate the object perimeter edge. The adapter is further configured to guide the at least one cable between the security device and the object perimeter edge such that the at least one cable remains generally secured proximate the object perimeter edge when the assembly is secured to the object.

In another embodiment, an assembly for securing a generally cylindrical object is provided. The object defines a first side defining a first object perimeter edge, and a second side defining a second object perimeter edge. The assembly comprises a security device, an adapter, and a second adapter. The security device comprises at least one cable extending from the security device. The adapter is configured for positioning proximate the first side of the object. The adapter also defines a pocket for receiving the security device and an edge lock configured for positioning proximate the first object perimeter edge. The adapter is further configured to guide the at least one cable between the security device and the first object perimeter edge such that the at least one cable remains generally secured proximate the first object perimeter edge when the assembly is secured to the object. The second adapter is configured for positioning proximate the second side of the object and defines a second edge lock configured for positioning proximate the second object perimeter edge. The adapter is further configured to guide the at least one cable proximate the second side of the object such that the at least one cable remains generally secured proximate the second object perimeter edge when the assembly is secured to the object.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
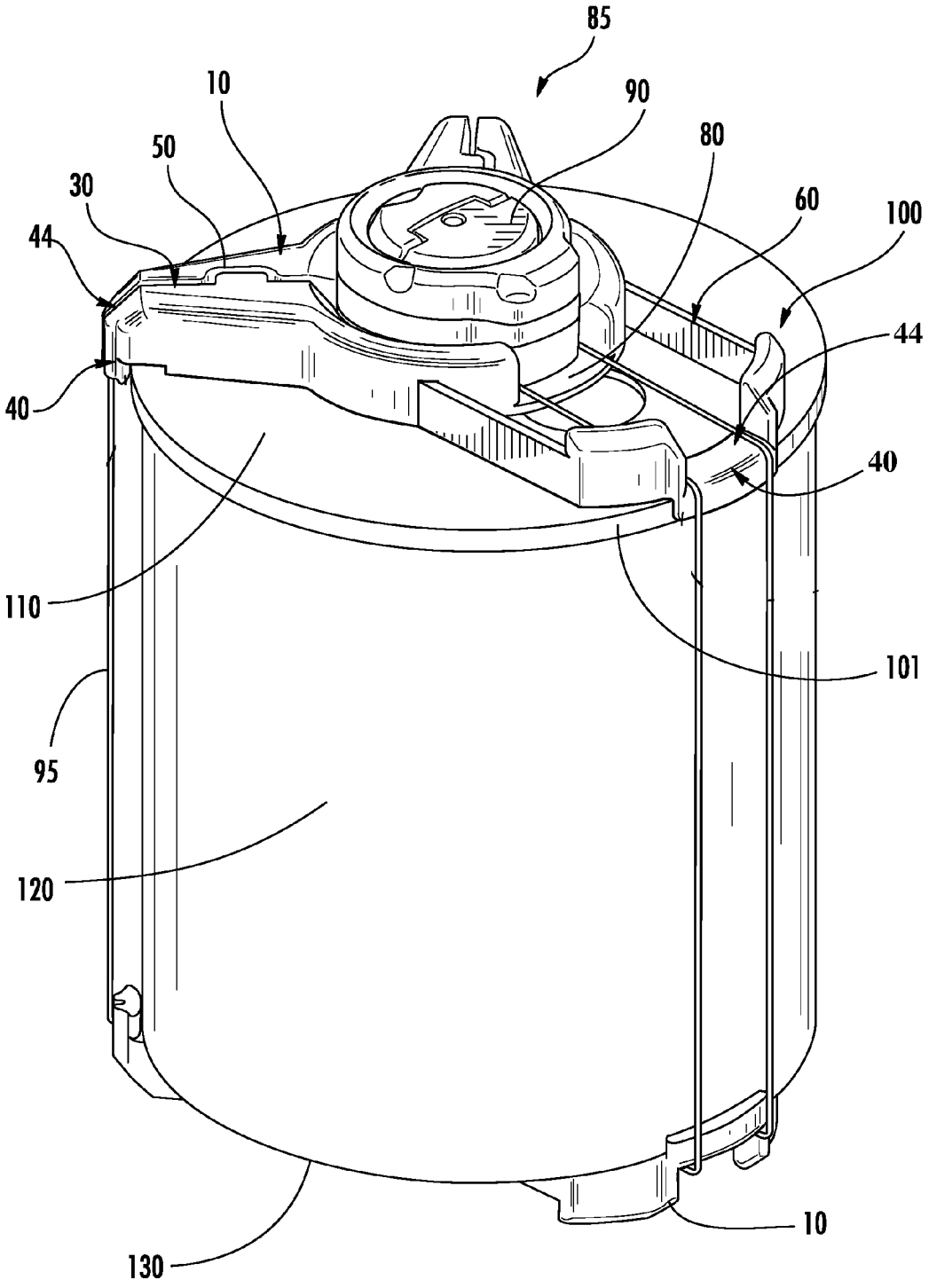
FIG. 1 is a perspective view of a security assembly fastened to a first object, wherein a flange of the security assembly is extended to fit the first object, in accordance with some embodiments discussed herein.

FIG. 1 shows a security assembly 85 fastened to an object 100 such as a retail product. In the depicted embodiment, the security assembly 85 comprises at least one adapter 10 and a security device 90. The security device 90 may be an electronic article surveillance (EAS) device or similar apparatus that is used to deter and detect shoplifting. For example, the security device 90 may be a cable wrap device as disclosed in commonly owned U.S. Pat. No. 7,497,101 and U.S. Patent Pub. No. 2009-0223260-A1, which are each hereby incorporated by reference in their entirety. In some embodiments, the security device may comprise at least one cable extending from the security device 90. In the depicted embodiment, the security device 90 comprises one cable 95 looped together and connected through the security device 90 such that four portions of the cable 95 extend from the security device 90. In some embodiments, the security device 90 may have more than one cable extending from the security device.

The adapter 10 may be configured to hold, position, and more securely fasten the security device 90 to objects 100 having a round, rounded, oval, or other non-square shape as discussed in greater detail below. The depicted adapter 10 includes a housing 30 and a telescoping flange 60. In reference to FIG. 4, in various embodiments, the housing 30 comprises a position feature 20 located generally centrally within a security device receiving portion of the adapter 10, an edge lock 40, and a channel 50 defined generally between the position feature 20 and the edge lock 40. The position feature 20 may define a ridge 25 that is configured to hold the security device 90 in a fixed position relative to the adapter 10 when the security device 90 is fastened to an object 100. For example, the position feature 20 may define a pocket for receiving the security device.

In other embodiments, the position feature 20 may not be associated with a ridge 25 or cavity and may instead simply consist of a visual indicator (e.g., dot, outline, bulls-eye, set of lines, etc.) or other locating feature that operates to assist a user to properly position the security device 90 when installing the security device 90 to the adapter 10. As will be apparent to one of ordinary skill in the art, a user could carry out such attachment using mechanical means (e.g., a snap fit arrangement between the security device and the adapter, fasteners, screws, etc. . . . ), adhesive means (e.g., double-sided adhesive tape, glue, etc. . . . ), or other retention means. In other embodiments, mechanical attachment between the security device 90 body and the adapter 10 may not be necessary as tension from the cable(s) that extend from the security device 90 may be adequate to maintain such attachment.

Embodiments of the present invention provide security assemblies to secure an object and, more particularly, in some cases, a non-square object. For example, some embodiments may secure a cylindrical object, such as object 100 shown in FIG. 1. In the depicted embodiment, the object 100 comprises an upper surface 110 (e.g., an adapter receiving surface), a lower surface 130 (e.g., an adapter receiving surface), and a rounded surface 120 (e.g., a cable receiving surface) extending therebetween. The upper surface 110 of the object 100 defines an upper perimeter edge 101 and the lower surface 130 of the object 100 defines a lower perimeter edge 131. The depicted object is a cylinder and, thus, the upper and lower surfaces 110, 130 are circular in shape. In other embodiments, however, the upper and lower surfaces 110, 130 may define ovals or other shapes having rounded corners that might prove difficult for secure attachment by traditional cable wrap security devices.

The depicted adapter 10 defines an edge lock 40 configured for positioning adjacent an edge of the object 100. For example, the edge lock 40 may be configured for positioning proximate the upper/lower perimeter edge 101, 131 of the object 100. In some embodiments, the edge lock 40 may define a flange, a tab, a barb, or other similar extension that is configured to capture an edge of the object 100. The depicted edge lock 40 defines a rounded profile to facilitate placement proximate the rounded perimeter edges of a secured object. In one embodiment, the edge lock 40 may define a rounded profile that generally matches the rounded perimeter edge of the object.

In the depicted embodiment, the adapter housing 30 defines two arms 35 that extend outwardly from the security device receiving portion of the adapter 10. The adapter housing 30 further defines a telescoping flange 60. Edge locks 40 are defined proximate respective ends of the two arms and the flange as shown. The edge locks 40 may operate to secure the adapter 10 in a fixed position relative to the object 100 when the security device 90 has been properly installed. As will also be apparent to one of ordinary skill in the art in view of this disclosure, the adapter 10 may define more or fewer arms or telescoping flanges depending on the shape of the object that is intended to be secured and other design considerations. Further, in embodiments where adapter size adjustment is not required, the adapter housing may omit the telescoping flange and discrete arms and may define a single edge lock that extends generally around the perimeter edge of the object 100.

In some embodiments, the security assembly may comprise at least one channel configured to direct at least a portion of the at least one cable from the security device to the perimeter edge of the object. For example, in the depicted embodiment of FIG. 1, the adapter 10 comprises a channel 50 defined from the security device 90 to the upper perimeter edge 101 of the object 100. As referenced in FIG. 8, and described in greater detail herein, various embodiments of the channel 50' may be further improved by channel walls 52' or nodules 55'. The channel walls or nodules may be configured to maintain the at least one cable within the channel such that the cable is unable to be lifted out of the channel or otherwise displaced to facilitate unauthorized removal of the object when the security assembly is secured to the object.

Figure 4:
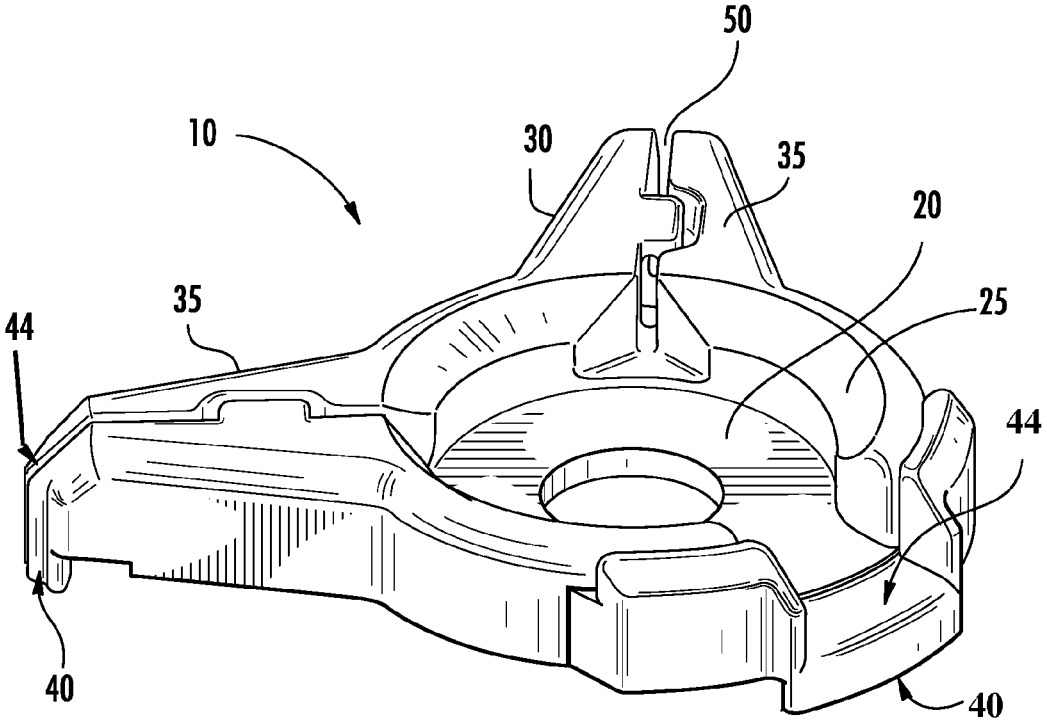
FIG. 4 is a perspective view of an adapter configured to receive a security device, in accordance with some embodiments discussed herein.
Figure 8:
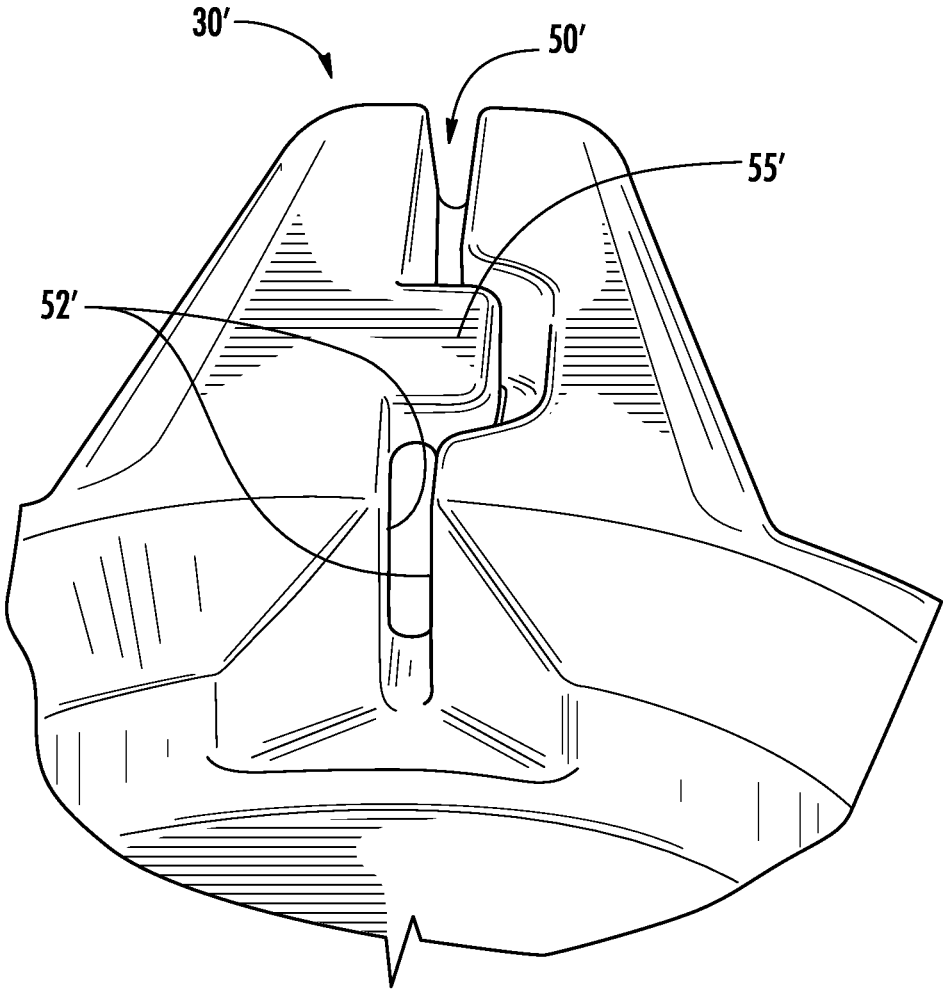
FIG. 8 is a detail view of the adapter shown in FIG. 4, which illustrates a portion of the adapter housing and channel defined therein, in accordance with some embodiments discussed herein.

In some embodiments, the security assembly may comprise at least one locating gap configured to guide the at least one cable between the security device and the perimeter edge of the object. In the depicted embodiment, the adapter 10 comprises at least one locating gap 44 (defined by the end of channel 50' as shown in FIG. 8) positioned proximate to the edge lock 40 and configured to guide the cable 95 around the upper perimeter edge 101 of the object 100. In various embodiments, the locating gap 44 may define a locating aperture, sidewalls, or tabs that secure one or more cables passing through such a gap 44 from lateral movement or manipulation of the magnitude necessary to squeeze a secured object between the cables and thereby defeat the security device. In some embodiments, the locating gap 44 is configured to secure the at least one cable from substantial lateral movement in at least one direction. For example, the locating gap 44 positioned proximate the flange 60 is configured to secure at least a portion of the cable proximate the perimeter edge 101 from substantial lateral movement in the direction of the flange channel wall 62 (shown in FIG. 5). Further, in some embodiments, the locating gap 44 is configured to secure the at least one cable from substantial lateral movement in at least two directions. For example, the locating gap 44 positioned proximate an arm 35 is configured to secure at least a portion of the cable proximate the perimeter edge 101 from substantial lateral movement in both lateral directions via walls that extend upward around the cable (shown in FIG. 1). As will be appreciated by one of ordinary skill in the art in view of this disclosure, locating gaps 44 are defined proximate each of the depicted arms and proximate the telescoping flange as shown in FIGS. 1, 4, and 5.

Figure 2:
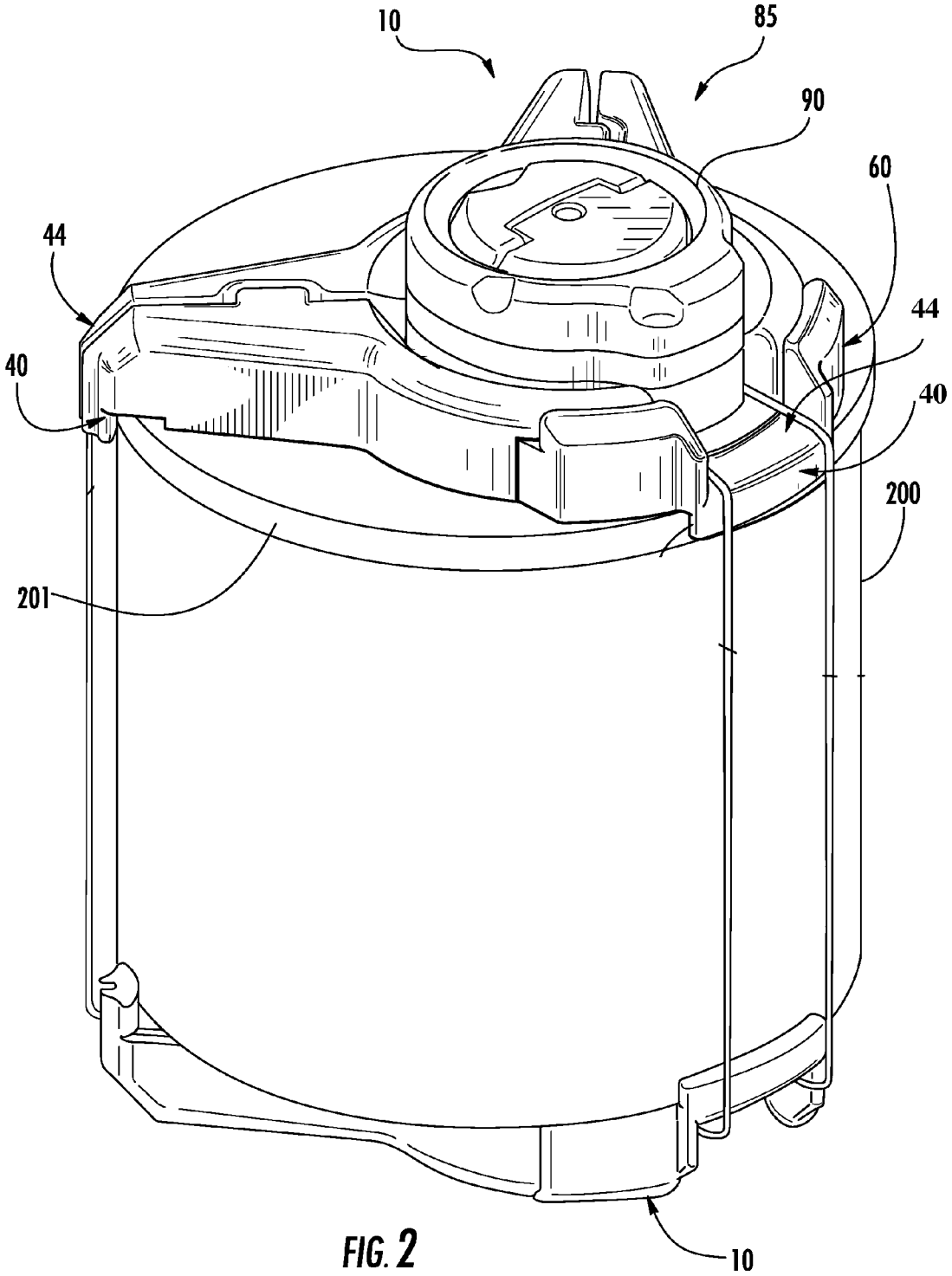
FIG. 2 is a perspective view of the security assembly shown in FIG. 1 fastened to a second object defining a smaller diameter than the first object of FIG. 1, wherein the flange is retracted to fit the second object, in accordance with some embodiments discussed herein.

The depicted housing 30 also comprises a telescoping flange 60, which is configured to extend and retract to allow the adapter 10 to fit differently sized objects 100. For example, FIG. 1 depicts the flange 60 disposed in a relatively extended state for fitting an object 100 defining a first size (i.e., having upper and lower surfaces of a first diameter), and FIG. 2 depicts the flange 60 disposed in a relatively retracted state for fitting an object 200 having a second, relatively smaller, size (i.e., having upper and lower surfaces of a second, relatively smaller, diameter).

Figure 5:
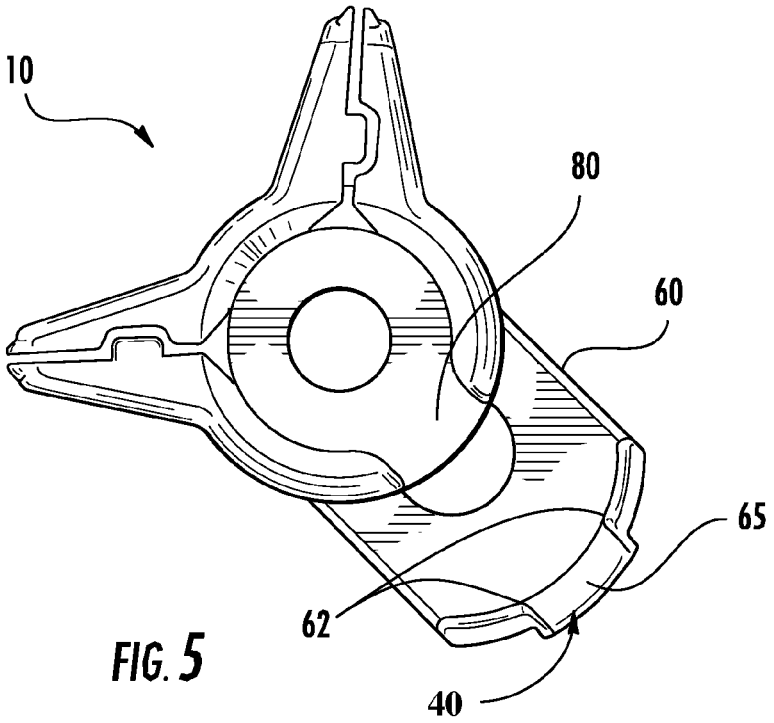
FIG. 5 is a top view of the adapter shown in FIG. 4, wherein a flange of the adapter is disposed in an extended position, in accordance with some embodiments discussed herein.

In reference to FIG. 5, the depicted flange 60 defines a flange channel 65 and an edge lock 40. In the depicted embodiment, the flange channel 65 is defined by opposing flange walls 62. Similar to the channels 50 mentioned above, the flange channel 65 operates to position and secure cables of the security device 90 once the security assembly 85 has been properly installed to an object 100. The flange channel 65 may also be configured to direct at least a portion of the at least one cable from the security device to the perimeter edge of the object. The depicted flange 60 further defines a locating gap 44 proximate the edge lock 40. The depicted locating gap 44 is a bit larger that then the locating gaps 44 discuss above with respect to the arms so as to accommodate two cable portions; however, each of the locating gaps discussed herein operate to secure any cable(s) passing there through from lateral movement or manipulation of the magnitude necessary to squeeze a secured object between the cables and thereby defeat the security device.

In some embodiments, the security assembly may comprise a security device, a first adapter, and a second adapter. With reference to FIG. 1, the object 100 may be a cylindrical object with an upper surface 110 and a lower surface 130. For such an object 100, the security assembly 85 may comprise a first adapter 10 adapted to secure the upper surface 110 and a second adapter 10' adapted to secure the lower surface 130. In some embodiments, the second adapter 10' may be configured with any and/or all of the features of the first adapter 10 as described herein. For example, the second adapter 10' may comprise an edge lock 40' configured for positioning proximate the lower surface 130 of the object 100. In some embodiments, the second adapter 10' may comprise a locating gap 44' configured to guide the cable 95 proximate the lower surface 130 of object 100 such that the cable 95 remains generally secured proximate the perimeter edge 131 of the lower surface 130 when the security assembly 85 is secured to the object 100.

Figure 6:
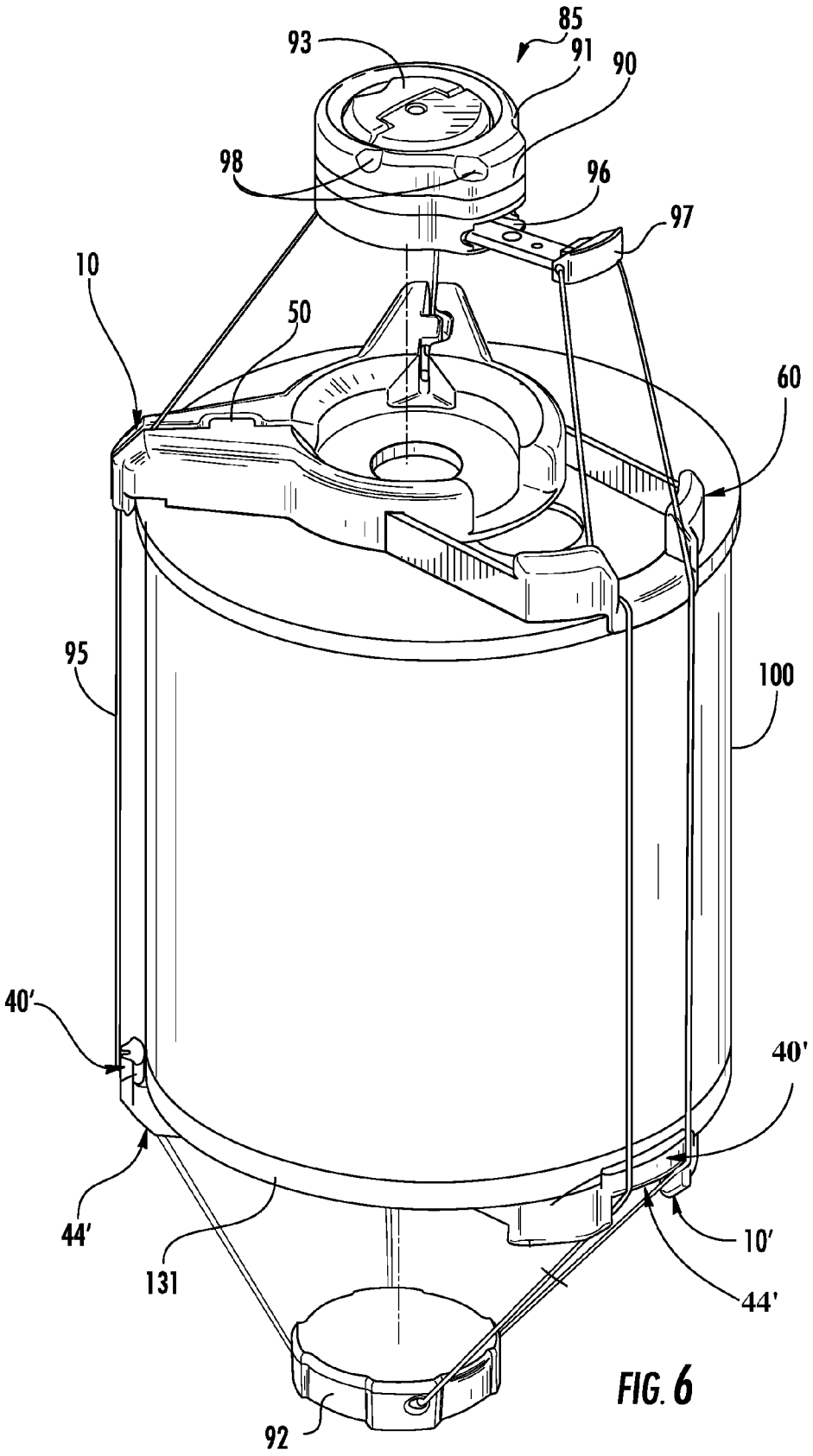
FIG. 6 is a perspective view of the security assembly shown in FIG. 1 disposed in a partially removed configuration wherein a security device has been displaced from both adapters, in accordance with some embodiments discussed herein.

Additionally or alternatively, with reference to FIG. 6, the security device 85 may comprise a first housing 91 and a second housing 92. In some embodiments, the second adapter 10' may comprise a position feature 20', or pocket, for receiving the second housing 92 of the security device 85.

As will be apparent to one of ordinary skill in the art, security assemblies structured in accordance with various embodiments of the present invention may be useful for securing cylindrical objects such as baby formula containers and the like. In some embodiments, adapters configured for positioning proximate opposite sides of the object may be configured to define differing shapes; for example, to conform to object having differently shaped opposite sides. In one embodiment, a single adapter could be used with a wire mesh net used to secure the other side of the object (e.g., the side without the adapter).

In still another embodiment, the first adapter and second adapter of an exemplary security assembly could be connected by a media, which would fully surround the object 100, thus, providing increased security. Such an embodiment could prevent damage to or tampering with the object 100 while it is housed within the security assembly 85. The media could be clear plastic, wire mesh, or any other type of media that would surround the object 100 to provide increased security.

The depicted embodiment of FIG. 1 shows a security assembly 85 securely engaging a cylindrical shaped object 100. The adjustability of the security assembly 85 allows it to work with many differently shaped objects. Likewise, one of ordinary skill in the art could easily customize the shape of the security assembly 85 to correspond to the shape of the object 100 desired to be secured.

In some embodiments, the security assembly may comprise an adapter and a security device, wherein the security device may comprise at least one cable and a winding mechanism. The winding mechanism may be configured to take-up (e.g., wind or spool the cable) such that the cable may be tightened around the adapter and/or the object meant to be secured. Additionally or alternatively, the security device may be configured to engage a number of differently configured and sized adapters. As such, in some embodiments, the security device may be configured to secure an object with one adapter, then be removed from the object and the adapter, and then be engaged with a different adapter that is configured to secure another differently sized or shaped object.

In some embodiments, such as that described herein, the security element (e.g., EAS tag, RFID tag, etc.) may be positioned, supported, and/or housed in the adapter for ease of packaging rather than strictly positioned in the same housing as the security device and/or cable winder mechanism (e.g., in a traditional cable wrap or security device). As such, the security element, which may positioned on the adapter that is secured to the object, may be configured to set off an alarm upon entering a surveillance zone (e.g., leaving the store) without proper deactivation. Therefore, as noted above, positioning the security element in the adapter may decrease the size and cost of the security device while still maintaining proper securing of the object by the security assembly.

The following description references FIGS. 1-7 to discuss installation and removal of an exemplary security assembly 85 in accordance with various embodiments of the invention. The depicted security assembly comprises a first adapter 10, a security device 90, and a second adapter 10'. The depicted security device 90 is a cable wrap security device as disclosed in commonly owned U.S. Patent Pub. No. 2009-0223260-A1, which is incorporated by reference in its entirety. The depicted security device 90 comprises a first housing 91, a second housing 92, a cable 95, and a locking plug 97.

To install the depicted security assembly 85 to an object 100 in hopes of deterring or reducing retail theft of the object 100, the user will first attach the security device 90 to the first and second adapter 10, 10'. As will be apparent to one of ordinary skill in the art, a user could carry out such attachment using mechanical means (e.g., a snap fit arrangement between the security device and the adapter, fasteners, screws, etc. . . . ), adhesive means (e.g., double-sided adhesive tape, glue, etc. . . . ), or other retention means. In order to accomplish attachment, in one embodiment, the user applies a double-sided adhesive tape to the side of the first housing 91 which will interact with the position feature 20 of the first adapter 10. Then, the first housing 91 is placed inside the position feature 20 so that the adhesive tape further connects the security device 90 to the first adapter 10. Such position feature 20 may contain ridges 25 that also help in the securing of the first housing 91. Next, the user repeats this process by applying double-sided adhesive tape to the side of the second housing 92 that will interact with the position feature 20' of the second adapter 10'. The second housing 92 is then placed inside the position feature 20' of the second adapter 10'.

Figure 7:
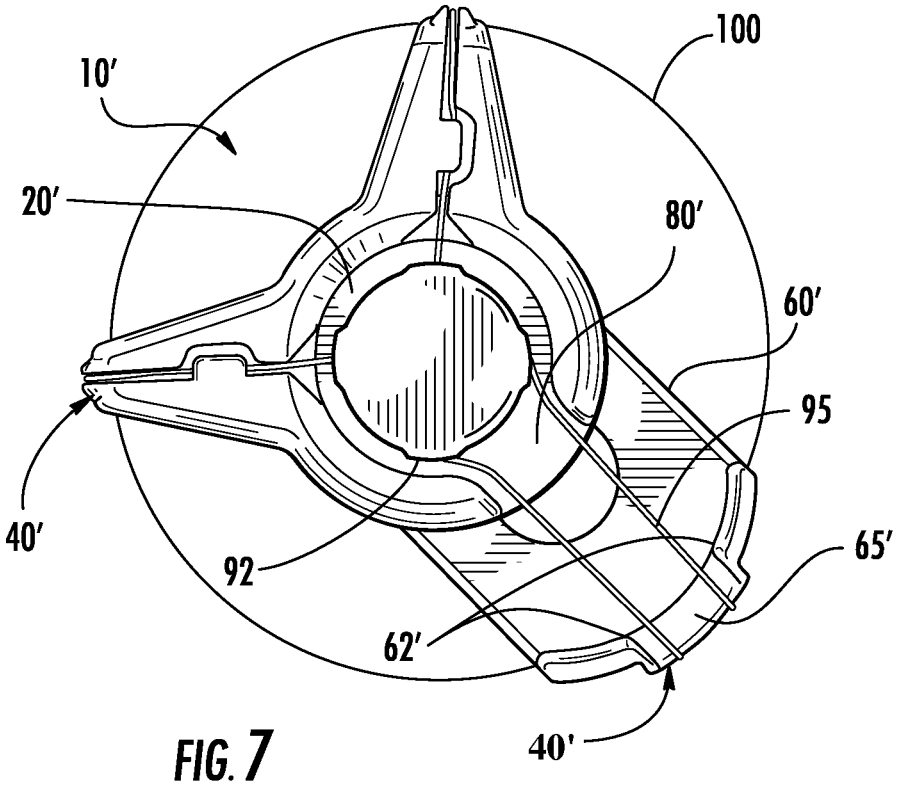
FIG. 7 is a bottom view of the security assembly shown in FIG. 1 fastened to the first object, in accordance with some embodiments discussed herein.

Referring to FIG. 7, the user continues installing the security assembly 85 by feeding the cable 95 through the channels 50'. As referenced in FIG. 8, various embodiments of the channel 50' are further improved by channel walls 52' or nodules 55'. In the depicted embodiment, the channel walls 52' extend the height of the channel 50', so that when the security device is engaged and the cables 95 tightened, the cables 95 cannot be lifted above the channel walls 52' and otherwise removed from the channel 50'. Additionally, the channel 50' may include at least one nodule 55' that is configured to extend from one channel wall 52' and at least partially covers the channel 50'. This nodule 55' further prevents the cable 95' from being lifted up out of the channel 50' when the security device is engaged and the cable 95 is tightened. The nodule 55' may also be configured to not intersect the other channel wall 52' so as to allow the cable 95 to be placed inside the channel 50' before tightening of the security device 90. The depicted channel 50' and corresponding channel walls 52' are curved around the nodule 55' so that the nodule 55' extends completely over the un-curved part of the channel 50'. This allows the cable 95 to lay flat in the channel 50' when tightened, while still having the nodule 55' cover over the cable 95 completely. Thus, when laying the cable 95 in the channels 50', the user can place the cable 95 in-between the channel walls 52' and around the nodule 55' so that it lays flat in the channel 50'.

The cable 95 is then run through the locating gap 44', over the edge lock 40', and toward the first adapter 10. In various embodiments of the invention, the edge lock 40' can be configured to allow the cable 95 to pass over it in a smooth fashion around its edge, such as having a curved outward facing edge.

Next, the user lays the cable through the flange channel 65', through the locating gap 44', and over the flange edge lock 40'. As referenced in FIG. 7, various embodiments of the flange 60' comprise a flange channel 65' that is configured as an opening to connect the position feature 20' to the flange edge lock 40'. The flange channel 65' is configured to allow the cables 95 to pass from the position feature 20' to and over the flange edge lock 40' so that the cable 95 can then engage the object 100. In the depicted embodiment, the flange channel 65' is defined within flange walls 62' that extend from the telescoping flange 60'. The flange channel 65' and locating gap 44' maintains the cables 95 in a secured position, thus, preventing outward lateral movement of a magnitude that would allow a thief to defeat the security device by squeezing the secured object through the cables 95.

Next, the cables 95 corresponding to the cables laid in the flange channel 65' of the second adapter 10' are run around the flange edge lock 40 of the first adapter 10. In similar fashion, the cables 95 corresponding to the edge locks 40' of the second adapter 10' are run over and around the corresponding edge locks 40 of the first adapter 10. The cables 95 are then routed through their corresponding locating gap 44 and channel 50 or flange locating gap 44 and flange channel 65. The channels 50 and flange channel 65 may contain nodules 55 or other securing features for which the cables 95 must be positioned around to lay flat in the first adapter 10.

Figure 3:
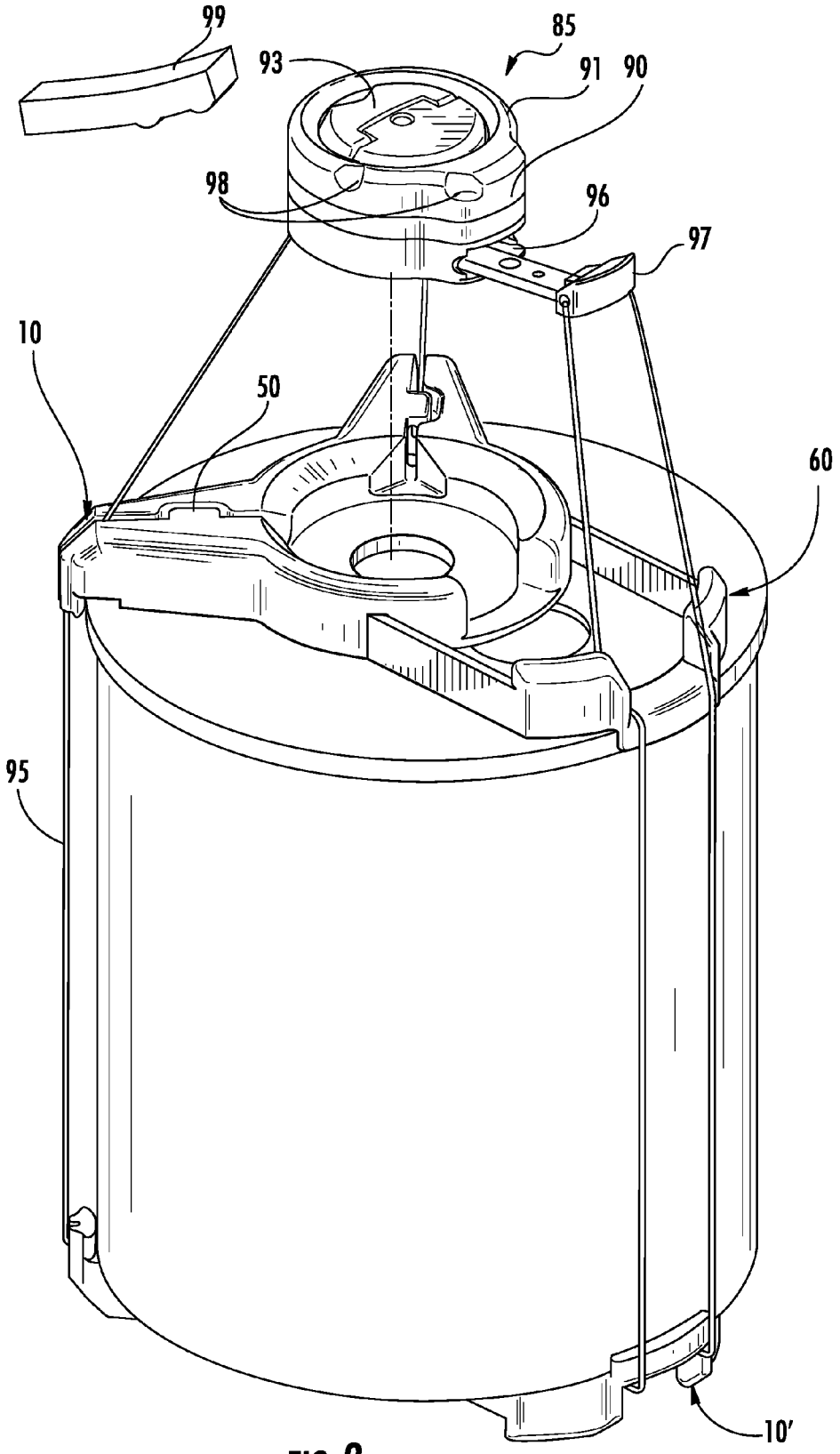
FIG. 3 is a perspective view of the security assembly shown in FIG. 1 disposed in a partially removed configuration wherein a security device has been displaced from an adapter, in accordance with some embodiments discussed herein.

As will be apparent to one of ordinary skill in the art, the first housing 91 of the security device 90 defines a plug cavity 96 that is configured to receive the locking plug 97. The locking plug 97 is thus positionable between a removed position, where the security device 90 is readily removable from the object 100, and an inserted position, where the security device 90 may be locked and, thus, may not be readily removed. FIG. 3 illustrates the locking plug 97 in a partially removed position.

With the first housing 91 secured in the position feature 20 of the first adapter 10 and the cables 95 properly laid in the channels 50 and flange channel 65, the user can fully insert the locking plug 97 into the plug cavity 96.

Next the user places the security assembly 85, with the first and second housing 91, 92 being attached to the first and second adapter 10, 10' respectively, around the object 100. To do so, a user first positions the first adapter 10 (with the first housing 91 attached) and the second adapter 10' (with the second housing 92 attached) proximate opposing sides of the object 100. The user then places the first adapter 10 on the object 100 while extending or retracting the telescoping flange 60 as necessary, so that the edge locks 40 and the flange edge lock 40 of the first adapter 10 engage the object 100 securely. The user repeats this process by placing the second adapter 10' on the object 100 while extending or retracting the telescoping flange 60' as necessary, so that the edge locks 40' and the flange edge lock 40' of the second adapter 10' engage the object 100 securely.

The user may then remove slack from the cables 95 by flipping up handle 93 and engaging (i.e., rotating handle 93) the ratchet assembly (not shown) housed within the first housing 91. With each rotation of the handle 93, slack is gradually removed and the security device 90 is tightly secured to the object 100.

To remove the depicted security assembly 85 from a secured object 100, a user must first unlock the cable wrap security device with a magnetic key 99. The key 99 is positioned proximate the first housing 91 of the security device 90 and is located by engaging indents 98 defined in the first housing 91. The magnetic field produced by the key 99 may disengage a locking mechanism (not shown) allowing the locking plug 97 to be removed from the plug cavity 96. An exemplary locking mechanism is discussed in commonly owned U.S. Patent Pub. No. 2009-0223260-A1, which is incorporated by reference in its entirety. In some embodiments, the locking mechanism may comprise an S3 spring. In other embodiments, the locking mechanism may comprise a magnetically actuated plug or tab that is removed from a locking slot upon application of an appropriately oriented magnetic field, such as from a magnetic key. Once the locking plug 97 has been removed from the plug cavity 96, the cables 95 should be slackened enough to allow the first and second adapter 10, 10' and attached security device 90 to be simply removed from the object 100.

As will be apparent to one of ordinary skill in the art, the security assembly 85 as described above still has the security device 90 attached to the corresponding first and second adapter 10, 10'. As such, the security assembly 85 may be stored for later use or moved to a second object for securing of that object.

In more specific reference to FIGS. 3 and 6, another embodiment of installation of the depicted security assembly 85 involves first attaching the first and second adapters 10, 10' to the object 100 and then attaching the security device 90 to the first and second adapters 10, 10'. This installation of the security assembly 85 to an object 100 requires a user to first position the first adapter 10 and the second adapter 10' proximate opposing sides of the object 100. The user then places the first adapter 10 on the object 100 while extending or retracting the telescoping flange 60 as necessary, so that the edge locks 40 and the flange edge lock 40 of the first adapter 10 engage the object 100 securely. The user repeats this process by placing the second adapter 10' on the object 100 while extending or retracting the telescoping flange 60' as necessary, so that the edge locks 40' and the flange edge lock 40' of the second adapter 10' engage the object 100 securely.

Referring to FIG. 7, the user continues installing the security assembly by placing the second housing 92 of the security device 90 proximate the position feature 20' of the second adapter 10'. In the depicted embodiment, the second housing 92 is seated within the position feature 20', i.e., positioned within a cavity defined by ridge 25'.

The user then feeds the cable 95 through the channels 50' by placing the cable 95 in-between the channel walls 52' and around the nodule 55' so that it lays flat in the channel 50'.

The cable 95 is then run through the locating gap 44', over the edge lock 40', and toward the object 100. In various embodiments of the invention, the edge lock 40' can be configured to allow the cable 95 to pass over it in a smooth fashion around the edge of the object 100, such as having a curved outward facing edge.

Next, the user lays the cable through the flange channel 65' against the flange channel walls 62'.

With the second housing 92 placed inside the second adapter 10' and the cable 95 laid inside the channels 50' and flange channel 65', the user then wraps the cable 95 around the object 100 toward the first adapter 10. The cables 95 corresponding to the cables laid in the flange channel 65' of the second adapter 10' are run around the flange edge lock 40 of the first adapter 10. In similar fashion, the cables 95 corresponding to the edge locks 40' of the second adapter 10' are run over and around the corresponding edge locks 40 of the first adapter 10.

As will be apparent to one of ordinary skill in the art, the first housing 91 of the security device 90 defines a plug cavity 96 that is configured to receive the locking plug 97. The locking plug 97 is thus positionable between a removed position, where the security device 90 is readily removable from the object 100, and an inserted position, where the security device 90 may be locked and, thus, may not be readily removed. FIG. 3 illustrates the locking plug 97 in a partially removed position. FIG. 3 further illustrates cables 95 extending from the locking plug 97 and the first housing 91 being routed through the locating gap 44 and flange locating gap 44 and over and around the edge locks 40 and flange edge lock 40 of the first adapter 10.

Once a user placed the security device 90 in the configuration shown in FIG. 3, the user would fully insert the locking plug 97 into the plug cavity 96. The cables 95 are then routed through their corresponding locating gap 44 and channel 50 or flange locating gap 44 and flange channel 65 and the first housing 91 is placed proximate the position feature 20 of the adapter 10. The user may then remove slack from the cables 95 by flipping up handle 93 and engaging (i.e., rotating handle 93) the ratchet assembly (not shown) housed within the first housing 91. With each rotation of the handle 93, slack is gradually removed and the security device 90 is tightly secured to the object 100.

To remove the depicted security assembly 85 from a secured object 100, a user must first unlock the cable wrap security device with a magnetic key 99. The key 99 is positioned proximate the first housing 91 of the security device 90 and is located by engaging indents 98 defined in the first housing 91. The magnetic field produced by the key 99 may disengage a locking mechanism (not shown) allowing the locking plug 97 to be removed from the plug cavity 96. An exemplary locking mechanism is discussed in commonly owned U.S. Patent Pub. No. 2009-0223260-A1, which is incorporated by reference in its entirety. Once the locking plug 97 has been removed from the plug cavity 96, the cables 95 may be removed from the channels 50 and the flange channel 65, and the first housing 91 may be removed from the first adapter 10. Similarly, the cables 95 may be removed from the channels 50' and the flange channel 65', and the second housing 92 may be removed from the second adapter 10'. Finally, the first and second adapters 10, 10' are simply removed from the object 100.

It will be appreciated that the present invention has more uses and advantages over known security assemblies and security devices. For example, some non-square objects are difficult to properly secure. These objects may have rounded sides or odd shapes that allow securing cables to be wiggled or slipped free despite being tightly wrapped. Additionally, some current security devices are not able to suit differently shaped or sized objects. Further, objects may be sold in stores on shelves and some current security devices may cover the tags and labels of the objects being secured. Moreover, some embodiments of the present invention can be adjusted to fit differently shaped objects, aligned so as to allow the labels on the objects to be viewed within the store, and secured so as to prevent the object from being wiggled or slipped free. A further benefit of the present invention is that it can be inexpensive and easy to manufacture.

In one or more of the embodiments discussed above, the security device may further include anti-theft features configured to provide one or more alerts in the event the security device is bypassed or object being secured is moved out of a specified area. For example, the anti-theft features may provide one or more of the following alerts: (1) activation of an alarm (audible and/or visual) at the location of a security gate (i.e., a gate alarm) when the object with the security device is physically moved through the security gate; (2) activation of an alarm (audible and/or visual) actually located inside or on the security device which is attached to the object when the object is physically moved through the security gate; and (3) activation of an alarm (audible and/or visual) in the security device when an attempt has been made to tamper with or bypass the locking mechanism (i.e., either the cable or the lock) of the security device. Details regarding methods and devices for providing such three alarm security are described in U.S. Publication No. 2006/0145848 entitled "Electronic Security Device and System for Articles of Merchandise," U.S. Pat. No. 7,474,209 entitled "Cable Alarm Security Device," and U.S. Pat. No. 7,497,101 entitled "Cable Wrap Security Device," the contents of each of which are incorporated by reference herein.

A security device, which may be any one of the security devices described herein, may comprise a housing that includes a security element inside the housing. The security element may be one of any number of devices that is configured to be detected by a security system such as an RFID transponder (e.g., an active tag, a passive tag, etc.) or an Electronic Article Surveillance (EAS) element. The EAS element may be configured to be detectable when the EAS element is present in a predetermined detection zone, such as a zone set up at or near the door or other entrance point of a warehouse or distribution center. The EAS element may be configured to work within an EAS security system. For example, the EAS element may include a magnetic tag, such as those used in an electromagnetic (EM) system or in an acousto-magnetic (AM) system. As another example, the EAS element may be configured to work within a microwave system.

The housing may also include other security or alarm features. For example, the housing may have an audible alarm device, such as a piezoelectric speaker, which may be triggered in response to one or more circumstances. In some embodiments, the housing may thus include a printed circuit board with a logic circuit, a sense loop configured to detect a fault condition associated with the security device (i.e., tampering with or bypassing the security device), and/or an energy source, such as a battery. The logic circuit may be disposed in communication with at least a portion of the security device described in various embodiments above to form a sense loop configured to detect a fault condition associated with the security device. In this way, any discontinuity (e.g., cutting of the cable or unexpected movement of the locking mechanism) in the sense loop may be recognized as a fault condition, which triggers alarm functionality as described in greater detail below.

Thus, according to some embodiments, the housing may include components that provide 1-alarm (e.g., alarming by a security gate at the security gate when the object is improperly moved past the gate), 2-alarm (e.g., alarming at the security gate when the object is moved and alarming by the security device attached to the object when the security device is tampered with or compromised), or 3-alarm (e.g., alarming at the security gate when the object is moved and alarming by the security device attached to the object when the security device is tampered with or compromised and alarming by the security device attached to the object when the object is improperly moved past the security gate) functionality to the security device and attached object.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A security device for securing an object, wherein the object defines an object perimeter edge, the security device comprising:

a housing defining an edge lock configured for positioning proximate the object perimeter edge and a locating gap; and at least one cable extending from the security device through the locating gap, wherein the locating gap is configured to secure the at least one cable from substantial lateral movement in at least one direction;

wherein the housing further defines a first arm defining the edge lock, a second arm defining a second edge lock, and a third arm defining a third edge lock, wherein each of the edge lock, the second edge lock, and the third edge lock, are configured to engage the object perimeter edge.

2. The security device according to claim 1, wherein the locating gap is adapted to secure the at least one cable proximate the object perimeter edge.

3. The security device according to claim 1, wherein the locating gap is configured to secure the at least one cable from lateral movement in at least two directions.

4. An assembly for securing an object, wherein the object defines an object perimeter edge, the assembly comprising:

a security device comprising at least one cable extending from the security device; and an adapter defining a pocket for receiving the security device and an edge lock configured for positioning proximate the object perimeter edge, wherein the adapter is further configured to guide the at least one cable between the security device and the object perimeter edge such that the at least one cable remains generally secured proximate the object perimeter edge when the assembly is secured to the object;

wherein the adapter comprises an arm defining the edge lock, and wherein the arm is movable relative to the pocket.

5. The assembly according to claim 4, wherein the edge lock defines a rounded profile to facilitate placement proximate a rounded object perimeter edge of a cylindrical object.

6. The assembly according to claim 4, wherein the adapter defines a locating gap configured to secure the at least one cable from substantial lateral movement in at least one direction.

7. The assembly according to claim 4, wherein the adapter comprises at least one channel configured to direct the at least one cable from the security device to the object perimeter edge.

8. The assembly according to claim 4, wherein the adapter comprises a first arm defining the edge lock, a second arm defining a second edge lock, and a third atm defining a third edge lock, wherein each of the edge lock, the second edge lock, and the third edge lock, are adapted to capture the object perimeter edge.

9. The assembly according to claim 8, wherein the first arm defines a first channel configured to direct the at least one cable from the security device to the object perimeter edge, the second arm defines a second channel configured to direct the at least one cable from the security device to the object perimeter edge, and the third arm defines a third channel configured to direct the at least one cable from the security device to the object perimeter edge.

10. The assembly according to claim 9, wherein the first arm is as telescoping flange that is configured to extend and retract to fit differently sized objects.

11. An assembly for securing a generally cylindrical object, wherein the object defines a first side defining a first object perimeter edge, and a second side defining a second object perimeter edge, the assembly comprising:

a security device comprising at least one cable extending from the security device;

an adapter configured for positioning proximate the first side of the object, the adapter defining a pocket for receiving the security device and an edge lock configured for positioning proximate the first object perimeter edge, wherein the adapter is further configured to guide the at least one cable between the security device and the first object perimeter edge such that the at least one cable remains generally secured proximate the first object perimeter edge when the assembly is secured to the object; and a second adapter configured for positioning proximate the second side of the object, the second adapter defining a second edge lock, configured for positioning, proximate the second object perimeter edge, wherein the adapter is further configured to guide the at least one cable proximate the second side of the object such that the at least one cable remains generally secured proximate the second object perimeter edge when the assembly is secured to the object wherein the adapter comprises a first arm defining the edge lock, a second arm defining a second arm edge lock, and a third arm defining a third arm edge lock, wherein each of the edge lock, the second arm edge lock, and the third arm edge lock are configured to capture the first object perimeter edge, and wherein the second adapter comprises a fourth arm defining the second edge lock, a fifth arm defining a fifth arm edge lock, and a sixth arm defining a sixth arm edge lock, wherein each of the second edge lock, the fifth arm edge lock, and the sixth arm edge lock are configured to capture the second object perimeter edge.

12. The assembly according to claim 11, wherein the security device comprises a first housing and second housing, and wherein the pocket of the adapter is configured to receive the first housing of the security device, and wherein the second adapter defines a second pocket for receiving, the second housing of the security device.

13. The assembly according to claim 11, wherein the edge lock defines a rounded profile to facilitate placement proximate a round first object perimeter edge, and wherein the second edge lock defines a rounded profile to facilitate placement proximate a round second object perimeter edge.

14. The assembly according to claim 11, wherein the adapter defines a locating gap adapted to maintain the at least one cable such that the at least one cable is secure proximate the first object perimeter edge, and wherein the second adapter defines a second gap adapted to maintain the at least one cable such that the at least one cable is secure proximate the second object perimeter edge.

15. The assembly according to claim 11, wherein the adapter comprises at least one channel configured to direct the at least one cable from the security device to the first object perimeter edge, and wherein the second adapter comprises at least one second channel configured to direct the at least one cable proximate the second side of the object.

16. The assembly according to claim 11, wherein the first arm defines a first channel configured to direct the at least one cable from the security device to the first object perimeter edge, the second arm defines a second channel configured to direct the at least one cable from the security device to the first object perimeter edge, and the third arm defines a third channel configured to direct the at least one cable from the security device to the first object perimeter edge, and wherein the fourth arm defines a fourth channel configured to direct the at least one cable proximate the second side of the object, the fifth arm defines a fifth channel configured to direct the at least one cable proximate the second side of the object, and the sixth arm defines a sixth channel configured to direct the at least one cable proximate the second side of the object.

17. The assembly according to claim 16, wherein the first arm comprises a telescoping flange configured to extend and retract to fit differently sized first sides of the object, and wherein fourth arm comprises a second telescoping flange configured to extend and retract to fit differently sized second sides of the object.

18. The assembly according to claim 4, wherein the security device is separable from the adapter.

* * * * *